US010109119B2

(12) United States Patent
Keane et al.

(10) Patent No.: US 10,109,119 B2
(45) Date of Patent: Oct. 23, 2018

(54) SYSTEM AND METHOD FOR AUTOMOTIVE DIAGNOSTIC TOOL DATA COLLECTION AND ANALYSIS

(71) Applicant: Robert Bosch GmbH, Stuttgart (DE)

(72) Inventors: Dennis Patrick Keane, Owatonna, MN (US); Darren Schumacher, Ann Arbor, MI (US); Gina Tuttle, Kalamazoo, MI (US)

(73) Assignee: Robert Bosch GmbH, Stuttgart (DE)

( * ) Notice: Subject to any disclaimer, the term of this patent is extended or adjusted under 35 U.S.C. 154(b) by 55 days.

(21) Appl. No.: 15/106,029

(22) PCT Filed: Dec. 23, 2014

(86) PCT No.: PCT/US2014/072021

§ 371 (c)(1),
(2) Date: Jun. 17, 2016

(87) PCT Pub. No.: WO2015/100278

PCT Pub. Date: Jul. 2, 2015

(65) Prior Publication Data

US 2016/0328890 A1 Nov. 10, 2016

Related U.S. Application Data

(60) Provisional application No. 61/920,171, filed on Dec. 23, 2013, provisional application No. 61/922,203, filed on Dec. 31, 2013.

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/0808; G07C 5/008
USPC ..... 701/31.5
See application file for complete search history.

(56) References Cited

U.S. PATENT DOCUMENTS 5,541,840 A * 7/1996 Gurne ..... B60T 8/885 701/29.3
6,181,992 B1 * 1/2001 Gurne ..... B60T 8/885 701/31.4
8,306,687 B2 11/2012 Chen
2008/0177438 A1 7/2008 Chen et al.
2009/0006476 A1 1/2009 Andreason et al.
(Continued)

OTHER PUBLICATIONS

International Search Report corresponding to PCT Application No. PCT/US2014/072021, dated Mar. 31, 2015 (4 pages).

*Primary Examiner* — Anne M Antonucci
*Assistant Examiner* — James E Stroud
(74) *Attorney, Agent, or Firm* — Maginot Moore & Beck LLP

(57) ABSTRACT

A method for monitoring component usage during vehicle service activities has been developed. The method includes receiving with a diagnostic tool diagnostic data from a vehicle, receiving with the diagnostic tool a component identifier corresponding to a component in the vehicle that is replaced in a service procedure in response to the diagnostic data from the diagnostic tool, transmitting with the diagnostic tool the diagnostic data and the component identifier to a server, and transmitting with the server the component identifier to a listener computing device that is associated with a manufacturer of the component.

6 Claims, 5 Drawing Sheets

(56) References Cited

U.S. PATENT DOCUMENTS

| | | | | |
|---|---|---|---|---|
| 2009/0276115 | A1* | 11/2009 | Chen | G07C 5/008 701/29.6 |
| 2010/0070442 | A1 | 3/2010 | Kreuter | |
| 2010/0174446 | A1 | 7/2010 | Andreason et al. | |
| 2011/0029186 | A1 | 2/2011 | Ishikawa | |
| 2011/0208567 | A9 | 8/2011 | Roddy et al. | |
| 2012/0123611 | A1 | 5/2012 | Grasso et al. | |
| 2012/0215398 | A1 | 8/2012 | Chen et al. | |
| 2012/0215754 | A1 | 8/2012 | Marzani et al. | |
| 2012/0296567 | A1* | 11/2012 | Breed | G01C 21/26 701/468 |
| 2013/0151065 | A1 | 6/2013 | Ricci | |
| 2014/0074346 | A1* | 3/2014 | Chiaverini | G07C 5/008 701/31.5 |
| 2014/0195101 | A1* | 7/2014 | Chen | G06F 17/30522 701/29.6 |
| 2016/0071334 | A1* | 3/2016 | Johnson | G06Q 10/20 701/29.1 |
| 2016/0078403 | A1* | 3/2016 | Sethi | G06Q 10/0875 705/26.81 |

* cited by examiner

SYSTEM AND METHOD FOR AUTOMOTIVE DIAGNOSTIC TOOL DATA COLLECTION AND ANALYSIS

CLAIM OF PRIORITY

This application is a 35 U.S.C. § 371 National Stage Application of PCT/US2014/072021, filed on Dec. 23, 2014, which claims the benefit of priority to (i) U.S. Provisional Application No. 61/920,171, which is entitled "System And Method For Automotive Diagnostic Tool Data Collection And Analysis," and was filed on Dec. 23, 2013, the entire contents of which are hereby incorporated by reference herein, and (ii) U.S. Provisional Application No. 61/922,203, which is entitled "System And Method For Semi-Automated Assistance In Automotive Diagnostics," and was filed Dec. 31, 2013, the entire contents of which are hereby incorporated by reference herein.

TECHNICAL FIELD

This disclosure relates generally to automotive maintenance systems and, more particularly, to systems that record and analyze automotive service activities.

BACKGROUND

In recent years, vehicles and the field of automotive maintenance have experienced rapid growth in computerized systems both within automotive vehicles and in computerized diagnostic tools that identify maintenance issues with the vehicles. Modern vehicles include one or more computer systems that are often referred to as an electronic control unit (ECU). In some vehicles, the ECU controls and monitors the operations of numerous systems including, but not limited to, the engine, steering, tires, transmission, brakes, fuel delivery or battery level monitoring, and climate control systems. Some vehicles also include numerous sensors that monitor various aspects of the operation of the vehicle. The ECU receives the sensor data and is configured to generate diagnostic trouble codes (DTCs) if the sensors indicate that one or more systems in the vehicle may be failing or operating outside of predetermined parameters.

Many vehicles use the controller area network (CAN) vehicle bus to transmit data between the ECU and the onboard sensors and components in the vehicle. The CAN bus, or other equivalent data networks in a vehicle, provides a common communication framework between the ECU and the various sensors and systems in the vehicle. Additionally, the CAN bus or equivalent network enables communication between the ECU and external diagnostic tools. Diagnostic tools are also digital computers with communication ports and input/output devices, including display screens and input control buttons, which relay information to a mechanic and enable the mechanic to perform tests and send commands to the ECU. The ECU and diagnostic tools often use an industry standard protocol, such as a version of the on-board diagnostics (OBD) protocol, including the OBD-II protocol. Automotive mechanics and service professionals use a wide range of digital diagnostic tools to interface with the ECUs in vehicles both to diagnose issues with the vehicles, which are often indicated by DTC data from the ECU. Some diagnostic tools are also configured to send commands to the ECU to provide direct control of certain systems within the vehicle during a service procedure. For example, a mechanic can send a command to test the starter motor and the engine in a more controlled manner than is feasible by starting the vehicle manually.

While automotive diagnostic tools are in widespread use today, the diagnostic tools are typically designed for isolated use with a vehicle. For example, most vehicles that arrive at a service center for maintenance are connected to a diagnostic tool to aid in diagnosing problems with the vehicle and to ensure than the problems are resolved after maintenance is performed. The diagnostic results are typically read by one or a small number of mechanics in the service center, and are only used during a particular service visit. Thus, while existing diagnostic tools certainly aid mechanics who perform automotive maintenance and repair, the existing diagnostic tools do not provide larger scale information about the overall scope of operations in a service center. For example, existing diagnostic systems do not generate detailed records about the frequency of common repair procedures, the time duration for the service procedures, the degree of success for the service procedures, the demand for replacement components that are used in the repairs, and other statistics. Some of this information may be recorded manually by mechanics and other service staff, but manual recording of data is both time consuming and prone to error. The issues are further compounded in larger services organizations that operate multiple service centers in many locations with hundreds or even thousands of employees. Consequently, improvements to diagnostic tools and data analysis systems that enable analysis of activities in automotive service centers would be beneficial.

SUMMARY

A vehicle maintenance analysis system provides a service with a partially public application programming interface (API) to automotive diagnostic tool manufacturers that enables diagnostic tools to transmit diagnostic data to a maintenance analysis service through a data network, and for listener computing devices to receive diagnostic data via a standard partially public API. The diagnostic data identify the general and specific types of vehicle that receive service at service centers, the types of maintenance that are performed on the vehicles, the diagnostic testing procedures that are performed using the diagnostic tools, and other information about the activities of service centers. The listener applications receive the diagnostic data and generate reports and summarizations of the service activities in one or more automotive service centers using the diagnostic data that are generated using the automotive diagnostic tools.

In one embodiment, a method for monitoring component usage during vehicle service activities has been developed. The method includes receiving with a diagnostic tool diagnostic data from a vehicle, receiving with the diagnostic tool a component identifier corresponding to a component in the vehicle that is replaced in a service procedure in response to the diagnostic data from the diagnostic tool, transmitting with the diagnostic tool the diagnostic data and the component identifier to a server, and transmitting with the server the component identifier to a listener computing device that is associated with a manufacturer of the component.

In another embodiment, a method for monitoring vehicle service activity has been developed. The method includes receiving with a plurality of diagnostic tools a plurality of diagnostic data from a plurality of vehicles, transmitting with the plurality of diagnostic tools the plurality of diagnostic data and a plurality of service records corresponding to a plurality of service procedures performed on the plurality of vehicles in response to the plurality of diagnostic data from the plurality of vehicles to a server, generating with the server a summary of the plurality of service procedures with reference to the plurality of service records and the plurality of plurality of diagnostic data from the plurality of diagnostic tools, and transmitting with the server the summary to a listener computing device associated with a service center that performs the first and second service procedures on the vehicle.

DETAILED DESCRIPTION

Figure 1:
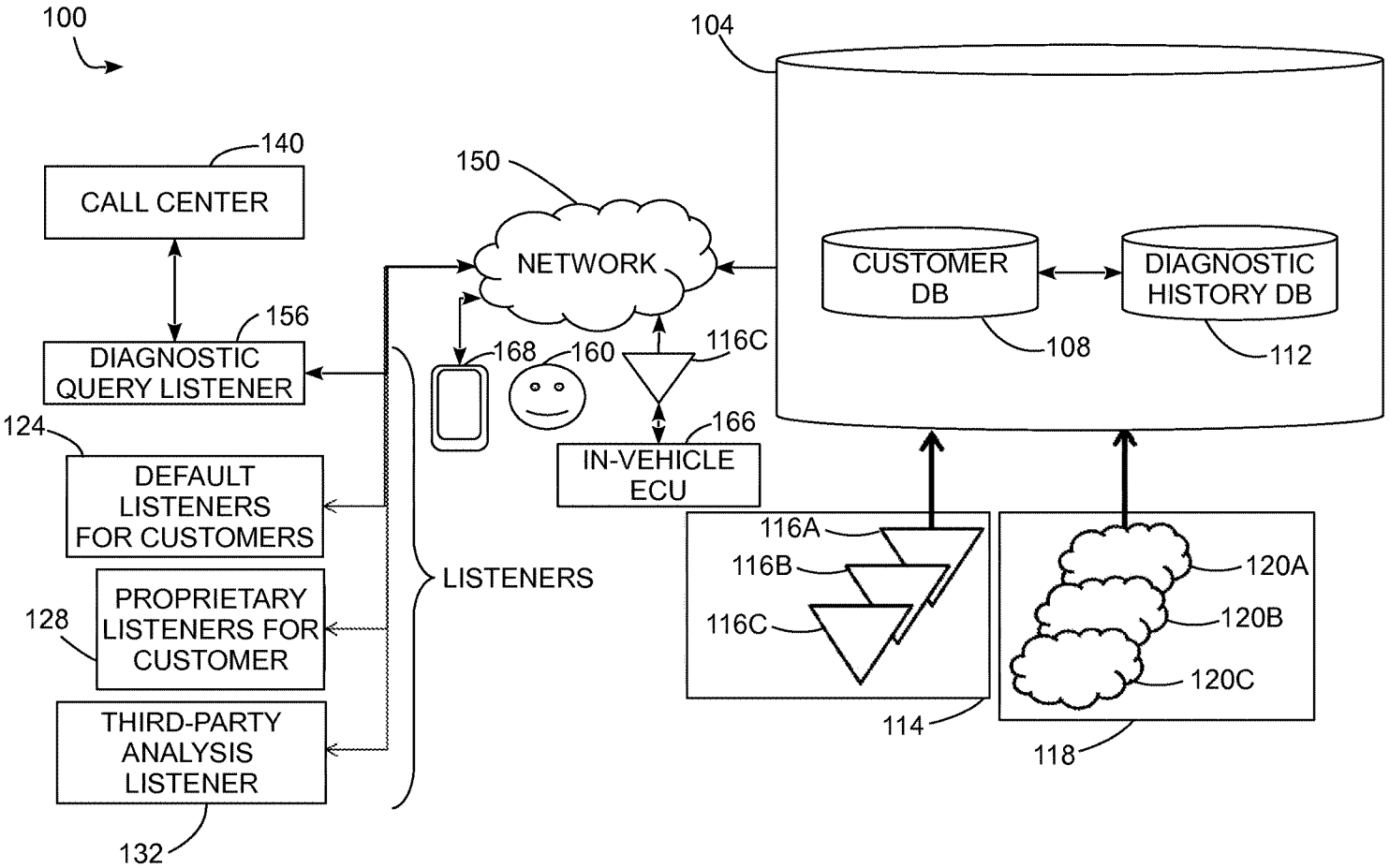
FIG. 1 is a schematic diagram of a system for automated retrieval, storage, and analysis of automotive diagnostic data that are generated during the course of automotive repair and servicing.

For the purposes of promoting an understanding of the principles of the embodiments described herein, reference is now be made to the drawings and descriptions in the following written specification. No limitation to the scope of the subject matter is intended by the references. This patent also includes any alterations and modifications to the illustrated embodiments and includes further applications of the principles of the described embodiments as would normally occur to one skilled in the art to which this document pertains.

As used herein, the term "customer" refers to an automotive service provider that uses diagnostic tools during automotive maintenance, sends data from the diagnostic tools to an online maintenance analysis service, and analyzes aggregated diagnostic tool data that are stored in the online maintenance analysis service. Examples of customers include individual mechanics, individual service shops that employ multiple mechanics, and larger service organizations that operate multiple service centers. Since many customers are organizations with multiple employees, individuals who are associated with a customer are assigned individual user accounts to access some or all of the data that the online maintenance analysis service receives from the customer.

As used herein, the term "third-party" refers to any individual or organization that accesses data stored in the online maintenance analysis service for one or more customers for analysis purposes. Most third-party users do not generate the diagnostic data through the vehicle service activities that the customers perform. Instead, the third-parties analyze trends and other statistics about the activities of one or more customers to, for example, improve the efficiency of product distribution to the customers. One example of a third-party is an automotive components supplier that analyzes the service trends of one or more customers to predict future demand for replacement components that the third-party supplier sells to the customers. The functions of customers and third-parties are described in more detail below. A third-party and a customer are often different organizations, but a single organization may perform the role of both a customer and a third-party roles.

As used herein, the term "listener" refers to a computing device that receives either raw diagnostic data or processed data that are generated from the diagnostic data from an online maintenance analysis service. In one embodiment, a listener that is associated with a customer receives an aggregation of the diagnostic data from one or more diagnostic tools employed by the customer from the maintenance analysis service. The listeners also receive summarizations and analysis reports from the maintenance analysis service in some embodiments. In addition to customers, the third-parties execute listener client applications that receive statistics or anonymized diagnostic data from the maintenance analysis service. In one embodiment, each customer has access to diagnostic data from diagnostic tools that are registered with each customer to prevent one customer from receiving diagnostic data that are generated by the other customer. A listener that is associated with a third-party may be able to retrieve diagnostic data from both parties, although the diagnostic data may be anonymized or otherwise redacted to limit the scope of access for the third-party listener. As described below, the maintenance analysis service implements software that is compatible with an application programming interface (API) that conforms to a publicly known specification. Consequently, different embodiments of listener client applications include software programs that retrieve some or all of the stored diagnostic data or other analysis data from the maintenance analysis service for display or additional processing.

FIG. 1 depicts a system 100 that monitors the automotive service activities of service centers for one or more customers using data that are generated by diagnostic tools and provides monitoring and analysis services for the customers and third-parties such as automotive component suppliers. As used herein, the term "service activity" refers to the aggregate operations that one or more mechanic or other automotive technicians perform on a motor vehicle. Examples of service activity include diagnostics, routine vehicle maintenance, vehicle repair, recall service, and the like. The system 100 includes an online diagnostic analysis system 104, diagnostic tools and other computing devices that are operated by customers 114 and 118 in the illustrative embodiment of FIG. 1, a default customer listener service 124, a proprietary listener service for a particular customer 128, a third-party listener 132, a diagnostic query listener 156, and a call center 140. For illustrative purposes, FIG. 1 depicts an automotive mechanic 160 who uses the diagnostic tool 116C to retrieve diagnostic data from an electronic control unit (ECU) in a motor vehicle as part of a vehicle maintenance process. The diagnostic tool 116C is one of the diagnostic tools 116A-116C that is associated with the customer 114 and an individual mechanic 160 in the system 100. The mechanic 160 optionally uses an electronic communication device 168, such as a smartphone, tablet, personal computer (PC) or other portable computing device, to communicate with the diagnostic analysis system 104 and the call center 140 to resolve maintenance issues with the vehicle.

In the system 100, the diagnostic analysis system 104 is implemented with one or computing devices that are configured to operate as servers and that are operatively connected to the computing devices associated with customers and third-parties through one or more data networks including local area networks (LANs), or wide area networks (WANs). In a large scale embodiment, the diagnostic analysis system 104 includes multiple servers in a clustered configuration with multiple digital processors, network interface devices, and data storage devices including solid-state or magnetic disk data storage devices that are arranged in a redundant array of independent disks (RAID). In one embodiment, the servers are connected to the data storage devices through a storage area network (SAN) configuration, a network-attached storage (NAS) configuration, or any other suitable configuration that enables the servers to access stored data.

The digital processors in the diagnostic analysis system 104 execute stored software program instructions to implement servers for communications with the computing devices of customers and third parties, databases to store and index data that are received from the customers and third-parties, and optionally one or more analysis engines that perform data analysis and generate reports, summarizations, and other analysis output for review by the customers and third parties. In one embodiment, the maintenance analysis service implements a public application programming interface (API) that is freely accessible to different customers. Examples of protocols that are suitable for the implementation of the public API between the diagnostic analysis system 104, diagnostic tools, and listeners include the XML-RPC, JSON-RPC, and SOAP protocols, which are examples of web-service protocols, and other middleware protocols including, but not limited to, traditional RPC, Java RMI, CORBA, and the like. In the embodiment of FIG. 1, the public API provides a common data format and interface for transmission of diagnostic data from one or more diagnostic tools from each customer, including the diagnostic tools 116A-116C and 120A-120C for customers 114 and 118, respectively, to the diagnostic analysis system 104 for storage.

The public APIs also provide predetermined interfaces to enable retrieval of the diagnostic tool data and analysis reports by customer listeners. In one embodiment, the diagnostic analysis system 104 implements a publish-subscribe (pub-sub) communication system in which the diagnostic analysis system 104 publishes or "pushes" diagnostic data that are received from the diagnostic tools for a particular customer to the listener computing devices that subscribe to the published data stream. In alternative embodiments, the listener computing devices download individual service records or groups of service records at regular intervals or on an ad-hoc basis. As used herein, the term "service record" refers to data that are generated during a service procedure that is performed on a vehicle. The service record includes, but is not limited to, diagnostic data that a diagnostic tool retrieves from an ECU in the vehicle, additional diagnostic information from various testing tools in a vehicle maintenance facility, a list of components that are replaced or repaired during the service activity, and a description of one or more service procedures that a mechanic performs during the service activity. In one embodiment, the diagnostic analysis system 104 formats the diagnostic data for display using, for example, HTML or another formatting language, and the listeners display the diagnostic data using a web browser or other suitable display program. In another embodiment, the listeners retrieve the diagnostic data and the listeners execute local software applications to generate graphical displays of the diagnostic data. In some embodiments, the diagnostic analysis system 104 performs additional analysis and generates summaries, graphs, and other reports that are generated based on the diagnostic data but do not necessarily include the diagnostic data directly.

To store the diagnostic data from one or more customers, the diagnostic analysis system 104 implements a customer database 108 and diagnostic database 112. The customer database 108 includes authentication information for receiving data from the diagnostic tools and for transmitting data to the different listener programs that are associated with different customers. The customer database also includes authentication information for third-party listeners. The diagnostic database 112 stores the diagnostic data that are received from the diagnostic tools. The customer database 108 associates the customer information with each record in the diagnostic database 112 to identify the customer that generated each service record. The databases 108 and 112 enable efficient storage, search, and retrieval of the diagnostic data from the diagnostic tools for transmission to the listeners or for the generation of reports using analysis software in the diagnostic analysis system 104. The databases 108 and 112 are implemented as, for example, relational databases, object stores, hierarchical databases, or with any other suitable data storage and retrieval format.

During data analysis and retrieval, the diagnostic analysis system 104 uses access control lists or other access control techniques to ensure that each listener only receives diagnostic data from an authorized customer. Additionally, the diagnostic analysis system 104 retrieves diagnostic data for one or more third-party listeners, and an access control or other filter removes or alters portions of the diagnostic data records to preserve anonymity. For example, if a service record includes a vehicle identification number (VIN) or other unique component identifier for a vehicle that is referenced in a service record, then the diagnostic analysis system 104 either removes the uniquely identifying data from the record, or applies a cryptographically secure hash to the unique ID to provide a pseudonymous record to the third-party listener.

In the system 100, each customer uses at least one diagnostic tool during the course of automotive maintenance and repair. FIG. 1 depicts two exemplary customers 114 and 118 that use the diagnostic tools 116A-116C and 120A-120C, respectively. Each diagnostic tool is a specialized computing device that is configured to interface with the ECUs in a wide range of vehicles, to record data from the ECUS, and to send commands to the ECUs. The diagnostic tools include user input and output devices including, for example, buttons, keyboards, switches, and touchscreens. The diagnostic tools also include a memory for storage of programmed instructions, the recorded diagnostic data from vehicles, and a record of commands and tests that are transmitted to the ECUs in vehicles during maintenance. In some embodiments, the diagnostic tool includes a network interface device that transmits recorded data to the diagnostic analysis system 104.

During operation, the diagnostic tools are connected to the ECUs in vehicles to retrieve vehicle information, trouble codes, sensor data from in-vehicle sensors, and to test the operation of one or more systems in the vehicle by generating commands for the ECU. When a diagnostic tool is connected to the ECU in a vehicle, the diagnostic tool retrieves the VIN or other identification information for the vehicle that enables automatic identification of the make and model of the vehicle under test. The diagnostic tool also records a data stream from sensors in the vehicle and any trouble codes from the ECU in the vehicle. Some diagnostic tool embodiments retrieve the diagnostic data in the OBD-II or other industry standard format that enables the diagnostic tool to be operatively connected to a wide range of vehicles. In the system 100, the diagnostic tools can be produced by multiple manufacturers. For example, in FIG. 1 the customer 114 uses diagnostic tools 116A-116C from a first manufacturer while the customer 118 uses diagnostic tools 120A-120C from a second manufacturer. In other embodiments, a single customer uses diagnostic tools from two or more manufacturers.

In the embodiment of FIG. 1, the diagnostic tools include a network interface device, such as a wired or wireless network interface device, that enables direct communication with the online diagnostic analysis system 104. The diagnostic tool generates a record of one or more interactions with a vehicle and transmits the records to the online diagnostic analysis system 104 using, for example, the TCP/IP protocol for data transmission and the public API for the diagnostic analysis system 104 to authenticate the diagnostic device with the appropriate customer account and to transmit the recorded data in a format that is compatible with the diagnostic analysis system 104. In an alternative configuration, if the diagnostic tool does not include a network interface device then the diagnostic tool stores the diagnostic data in an internal memory or a removable memory device. The stored diagnostic data are subsequently transferred to a PC or other computing device that transmits the diagnostic data to the diagnostic analysis system 104. In some embodiments where an existing diagnostic tool cannot be updated to use the public APIs for communication with the diagnostic analysis system 104, the stored diagnostic data are transferred to a PC that executes a translation program to convert the diagnostic data into a format that is compatible with the public API and transmit the data to the diagnostic analysis system 104.

In one operating mode, the diagnostic tools transmit diagnostic data to the diagnostic analysis system 104 without requiring additional input from a mechanic or other operator. For example, the maintenance tool 116C for the customer 114 includes a memory with a stored authentication key that is registered with the customer database 108 for the customer 114. The authentication key or another unique identifier stored in the memory of the maintenance tool 116C enable the diagnostic analysis system 104 to identify the particular diagnostic tool that produces each service record for storage in the diagnostic database 112. When a mechanic connects the maintenance tool 116C to a vehicle, the maintenance tool 116C sends a first record to the diagnostic analysis system 104 that includes identification information for the vehicle. The maintenance tool 116C generates additional diagnostic data records as the mechanic retrieves trouble codes, streams data from the vehicle, and performs additional tests during the maintenance process. In one embodiment, the diagnostic tool 116C also transmits a service record to the diagnostic analysis system 104 when the diagnostic tool 116C is disconnected from the vehicle to enable a listener program to identify the length of time for each session between a diagnostic tool and a vehicle. In one embodiment, the diagnostic tool 116C records a timestamp corresponding to the time of generation for each set of diagnostic data to enable analysis of the time at which each test or operation is performed. In the system 100, the diagnostic tools transmit the diagnostic data to the diagnostic analysis system 104 without requiring additional input from a mechanic or otherwise presenting distractions to the mechanic. Thus, the system 100 enables diagnostic data collection with little or no additional burden on the staff of the automotive service centers to record diagnostic data manually.

In the illustrative embodiment of FIG. 1, the system 100 includes the listeners 124, 128, 132, and 156. Each of the listeners is a software application that is executed, at least in part, on a consumer electronic device such as a PC, smartphone, or tablet. As described below, some listener embodiments that perform computationally intensive analysis of diagnostic data that require additional processing capabilities beyond the capabilities of a single computing device such as a single personal computer (PC). In these embodiments, a customer or third-party implements a compute cluster or other computing system with sufficient processing capabilities to perform the analysis, and a listener client displays the analysis results.

The listener 124 is a "default" listener program that is provided to customers for monitoring the diagnostic data in the diagnostic analysis system 104. In one embodiment, default listener is implemented as a dynamic web application that retrieves some or all of the diagnostic data from the diagnostic analysis system 104 and displays the status and recent usage history for each of the diagnostic devices and the corresponding vehicle information for the vehicles that undergo service at one or more service centers. The default listener also provides one or more summarized reports for the diagnostic data over a predetermined time period, such as the previous hour, day, week, or month. The reports include text and graphics that provide a "dashboard" overview of information from the diagnostic analysis system 104 with a user interface that enables the retrieval and display of detailed service records on demand. For example, in one configuration the listener presents a key performance indicator (KPI) graphical display that provides a graphical meter of the total number of vehicle diagnostic tests that have been performed in a service center during a work shift. For larger customers that operate multiple service centers, the default listener is configured to present different scopes of data in conjunction with different user accounts that are registered with the customer. For example, the listener presents diagnostic data and reports for only the activity in a single service center to a local manager of the service center. The local manager may review more detailed information about the specific diagnostics for specific vehicles that are present at the service center. For a regional manager, the listener presents condensed reports that summarize the activities of multiple service centers. The condensed reports include aggregate statistics about the overall activities of the service centers, and may omit detailed service record data unless the regional manager specifically requests the detailed data from the diagnostic analysis system 104.

Some customers optionally implement a proprietary listener, such as the listener 128. The proprietary listener includes any software program that implements the public API to retrieve diagnostic data for the customer from the diagnostic analysis system 104, but that differs from the default listener 124. Proprietary listeners are generally implemented by a customer to perform additional analysis of diagnostic data that extends the functionality provided by the diagnostic analysis system 104 or the default listener 124. Some proprietary listeners are implemented as plugins or other functional extensions of the default listener application 124. In another embodiment, the proprietary listener 128 includes another compute cluster that performs further analysis of the customer-specific diagnostic data and presents the results of the analysis to the customer.

The third-party listener 132 is a software program that receives some of the diagnostic data the diagnostic database 112 for one or more of the customers, and presents reports and other analysis based on the diagnostic data. As described above, the third-party is granted permission to receive a portion of the diagnostic data from one or more of the customers, such as the customers 114 and 118. For example, if the third-party is an automotive component supplier, then the customers that buy components from the supplier grant permission for the third-party supplier to receive some of the diagnostic data from the diagnostic database 112. Other customers that do not use the third-party supplier may elect to deny access to the third-party supplier. The diagnostic analysis system 104 implements access control lists (ACLs) or other access control techniques that are known to the art to enable the third-party listener 132 to retrieve only the portions of diagnostic data for which the third-party is granted permission. In one embodiment, the supplier receives redacted service records that remove or modify unique-identifier data such as VINs while preserving detailed information about the diagnostic processes and service activities that each customer performs. In another embodiment, the third-party listener 132 receives summarized data from the diagnostic analysis system 104. In either embodiment, the third-party listener 132 generates an interface that provides relevant information to the third-party pertaining to the automotive service activities of one or more customers.

For example, a third-party supplier that sells spark plugs to a customer receives a summary of the number of service operations that likely include the replacement of spark plugs. The third-party listener 132 receives either the direct diagnostic data or summarized diagnostic data about a number of service procedures that typically include the replacement of spark plugs from the diagnostic analysis system 104. In one embodiment, diagnostic trouble codes that indicate problems with the combustion in one or more cylinders of a gasoline engine indicate the need for new spark plugs. If the diagnostic data also include tests that confirm the combustion of the engine after a service procedure, then the diagnostic analysis system 104 or the third-party listener 132 use the series of diagnostic data to identify that the service procedure likely included the replacement of spark plugs. The third-party listener presents reports of the estimated consumption of spark plugs for multiple consumers. The third-party supplier then uses the information to increase or decrease orders for spark plugs or to ship spark plug inventory from regions of lower demand to regions of higher demand.

In the system 100, the diagnostic query listeners 156 receive requests for assistance from diagnostic tools or other electronic communication devices that are associated with a mechanic, such as the diagnostic tool 116C and electronic communication device 168 that are associated with the mechanic 160 in FIG. 1. In some embodiments, the diagnostic query listener 156 is implemented as a proprietary listener 128 that provides additional services based on the diagnostic data received from the diagnostic tools. The diagnostic query listeners 156 receive search queries and diagnostic data, such as DTCs and the VIN information, from the diagnostic tool 116. In some configurations, the mechanic 160 enters additional search terms or other information about the vehicle to assist in diagnosing an issue during vehicle maintenance. The diagnostic query listeners 156 retrieve maintenance information from the diagnostic history database 112 based on the DTC information from the diagnostic tool 116C. The diagnostic query listeners 156 also narrow searches for maintenance information in the diagnostic history database 112 based on the vehicle make, model, and year, which the diagnostic query listeners 156 identify from the VIN transmitted from the diagnostic tool 116C. The diagnostic query listener 156 transmits service procedure data including, for example, written and graphical service procedure guides, replacement component information, and other relevant maintenance information to the diagnostic tool 116C or electronic communication device 168 for review by the mechanic 160.

In some instances, the maintenance information from the diagnostic history database 112 does not enable the mechanic 160 to resolve the mechanical issue. The mechanic 160 uses the diagnostic tool 116C or electronic communication device 168 to contact the call center 140 for additional assistance. In the system 100, the diagnostic query listener 156 establishes a communication channel between the call center 140 and the devices 116C or 168 that are associated with the mechanic 160. The diagnostic query listener 156 forwards diagnostic data, such as DTC data, VIN information, vehicle history data, and information about previous maintenance processes to the call center 140. The call center 140 receives the diagnostic data, and a terminal or other suitable data display device presents the diagnostic data to a technician in the call center 140. Thus, the system 100 enables the technician in the call center to review diagnostic information related to the vehicle without requiring the mechanic 160 to report the diagnostic information manually during a telephone conversation or other communication session.

Figure 2:
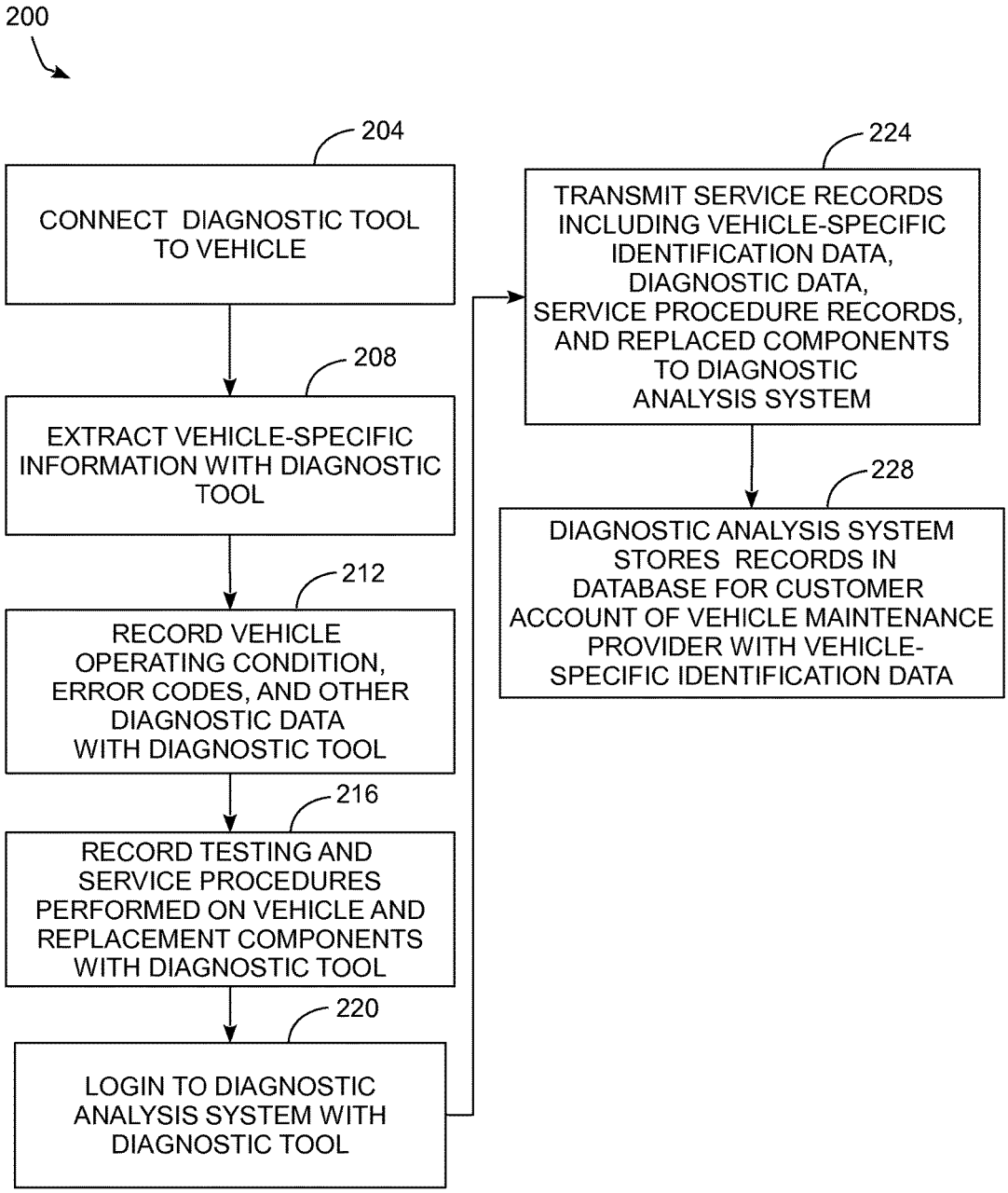
FIG. 2 is a block diagram of a process for generation and collection of automotive diagnostic information with a diagnostic tool.

FIG. 2 depicts a process 200 for the operation of the system 100 to generate and transmit diagnostic data from a diagnostic tool to a maintenance analysis service during a service procedure. Process 200 is described in conjunction with the system 100 of FIG. 1 for illustrative purposes.

Process 200 begins when a mechanic or other automotive service technician connects a diagnostic tool to the ECU in a vehicle (block 204). As described above, the diagnostic tools 116A-116C and 120A-120C are configured to interface with a CAN bus or other in-vehicle data networking interface to retrieve diagnostic data from the ECU. The diagnostic tool extracts vehicle-specific information (block 208) to identify the vehicle automatically. For example, the ECUs in many vehicles include a memory that stores the VIN for the vehicle, and the diagnostic tool retrieves the VIN using the OBD-II mode 9 protocol or another suitable diagnostic protocol. In the embodiment of FIG. 1, the diagnostic analysis system 104 stores or accesses databases of predetermined VINs to identify the make, model, and year of manufacture for a vehicle from the retrieved VIN if the diagnostic tool does not retrieve the make, model, and year information directly.

During process 200, the diagnostic tool records error codes, such as the diagnostic trouble codes, operating condition information, and other diagnostic data from the ECU in the vehicle (block 212). During a maintenance process, the retrieval of error codes typically occurs during initial diagnosis of the maintenance issue or after a repair to verify if the repair has been effective. During the course of maintenance, the diagnostic tool optionally performs tests or sends commands to the ECU, and the diagnostic tool stores a record of the diagnostic tests, commands for the vehicle ECU, and a record of service procedures and components that are replaced in the vehicle as part of the service procedures in the memory (block 216). For example, during a service visit the diagnostic tool 116C retrieves diagnostic data at multiple times and sends multiple test commands to the ECU 166 in the vehicle. The mechanic 160 performs one or more service procedures in response to receiving DTCs and other diagnostic data from the diagnostic tool 116C. The diagnostic tool 116C also receives a record of component identifiers corresponding to components that the mechanic 160 replaces in the vehicle during the service procedures. The diagnostic tool continues to record the diagnostic and test data for multiple operations during the service visit. The list of component identifiers includes, for example, stock keeping unit (SKU) numbers, serial numbers, or other component identification data that correspond to any components in the vehicle that are replaced during a service procedure. For example, the diagnostic tool 116C transmits a SKU corresponding to a replacement muffler component when the mechanic 160 replaces the muffler component in response to diagnostic data from the diagnostic tool 116C that indicates a service procedure for the muffler. In some embodiments, the diagnostic tool 116C or electronic communication device 168 include a barcode scanner or radio frequency identifier (RFID) reader that scan the SKUs of replacement components to collect the component identification data during the service procedure.

During process 200, the diagnostic tool performs a login to access the diagnostic analysis system 104 (block 220). In one embodiment, the diagnostic tool is configured to with a predetermined login identifier, such as a hardware globally unique identifier (GUID) for the diagnostic tool, and password or cryptographic key that enables the diagnostic tool to login to an account registered with the appropriate customer organization in an automated manner. In some embodiments, the login process establishes a communication channel between the diagnostic tool and the diagnostic analysis system 104 to enable the diagnostic tool to transmit multiple diagnostic data records during the session. In another embodiment, the login process is incorporated with the transmission of each diagnostic data record to the maintenance analysis service. Each diagnostic tool includes either the GUID or another identifier that is used to associate diagnostic data records in the diagnostic analysis system 104 with a specific diagnostic tool. The service records corresponding to each diagnostic tool are further associated with the customer that operates the diagnostic tool.

After the login process is completed, the diagnostic tool transmits service records including vehicle-specific identification data, diagnostic data, service and repair procedure records, and a list of any components in the vehicle that were replaced during the service procedure to the diagnostic analysis system 104 (block 224). As described above in FIG. 1, the diagnostic tool executes software that formats the recorded data from the vehicle into a data format that is compatible with the public API for the diagnostic analysis system 104. In one embodiment of the process 200, the diagnostic tool performs the login and transmits one or more data records after completion of the vehicle service. In another embodiment, the login occurs prior to or during the connection of the diagnostic tool to the vehicle that is described above with reference to the processing of block 204. The diagnostic tool then transmits the service records to the diagnostic analysis system 104 with minimal delay in a "live" operating mode during the diagnostic and test processes, which enables listeners to retrieve the service records from the diagnostic analysis system 104 during a service procedure to provide a current account of the activities that the diagnostic tool performs.

During process 200, the diagnostic analysis system 104 stores the data that are received from the diagnostic tool in the diagnostic database 112 (block 228). The diagnostic analysis system 104 stores the service records, replacement component identifiers, and any other data received from the diagnostic tools in the diagnostic history database 112 in association with the identifier of the diagnostic tool, an identifier for the customer account in the customer database 108, the VIN or other identifier for the vehicle that is connected to the diagnostic tool, and a timestamp of when the diagnostic tool receives data or sends a command to the ECU in the vehicle. During the course of vehicle maintenance, the diagnostic tool can send multiple records to the diagnostic analysis system 104 that are stored in the diagnostic database 112.

Figure 3:
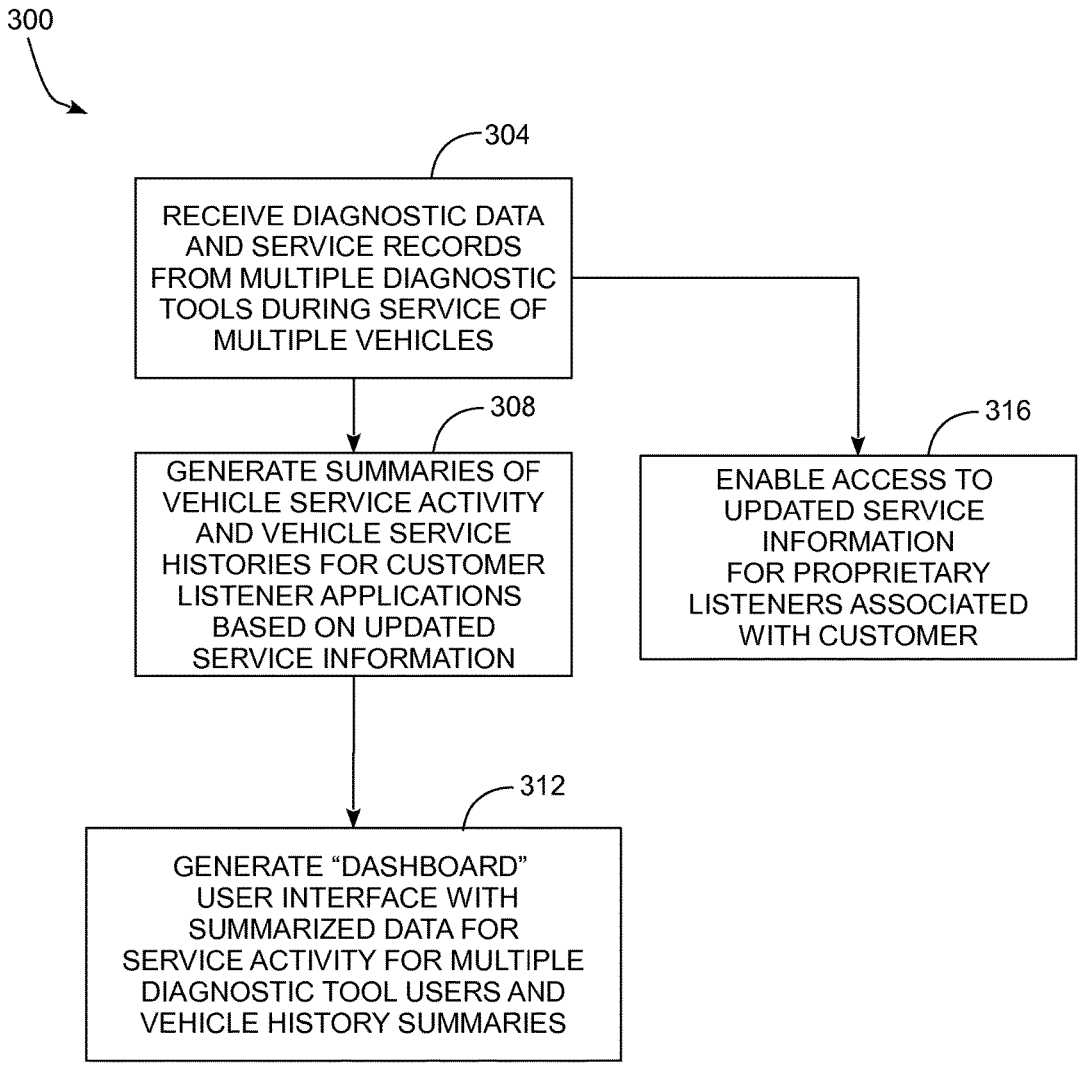
FIG. 3 is a block diagram of a process for generation of summarized reports that track the automotive service activities of one or more related automotive service centers using data generated by diagnostic tools.

FIG. 3 depicts a process 300 for operation of a customer listener that receives data from a maintenance analysis service. The customer listener receives summaries of diagnostic data and service records from a plurality of diagnostic tools during service of multiple vehicles, and to generate vehicle history summaries corresponding to multiple service procedures that are performed on a single vehicle. The process 300 is described with reference to the system 100 of FIG. 1 for illustrative purposes.

During process 300, the diagnostic analysis system receives multiple sets of diagnostic data and service records from a plurality of diagnostic tools, such as the diagnostic tools 116A-116C in the system 100 (block 304). The service information includes both the immediate diagnostic and test data that the diagnostic tools send to the diagnostic analysis system 104, and summarized information and reports from the diagnostic analysis system 104. The customer listeners 124 and 128 can access the service records and summarized data from the diagnostic analysis system 104. In one configuration, the customer listeners 124 and 128 are registered with the customer 114 and receive updated service information that the diagnostic analysis system 104 receives during the operation of diagnostic tools 116A-116C as described above with reference to the process 200. Each customer uses one or more listeners to receive the service information from the diagnostic analysis system 104, and a single customer employs any combination of the default listener and one or more proprietary listeners that interface with the diagnostic analysis system 104. The multiple diagnostic tools 116A-116C generate multiple service records as the diagnostic tools retrieve diagnostic data and receive service records for multiple vehicles. The diagnostic tools 116A-116C transmit the diagnostic data and service records to the diagnostic analysis system 104. Additionally, the diagnostic tools 116A-116C retrieve the VINs from different vehicles, and the diagnostic analysis system 104 tracks multiple sets of diagnostic data and service records that correspond to a single vehicle with reference to the VIN data. For example, the diagnostic analysis system 104 generates a summary of the vehicle service history, including a summary of diagnostic data and service records, for a single vehicle that is connected to one of the diagnostic devices 116A-116C on two separate service visits.

The diagnostic analysis system 104 uses authentication data stored in the customer database 108 to authenticate the listeners 124 and 128 using, for example, passwords or cryptographic authentication keys, and the diagnostic analysis system 104 only transmits service information from the diagnostic database 112 that are associated with the customer 114 to the default listener 124 and the proprietary listener 128. A different set of listeners that are associated with the customer 118 receive similar service record data corresponding to the diagnostic tools 120A-120C, and the customers 114 and 118 do not have direct access to each other's data.

During process 300, either or both of the diagnostic analysis system 104 and the default listener 124 generate summarized data and perform other data analysis using the service information (block 308). For example, in one embodiment the default listener 124 reformats diagnostic data records with a brief, human-readable summary of the service record. For example, a service record that includes a trouble code for an oxygen sensor is reformatted into a string that includes the make, model and year of the vehicle, a human-readable explanation of the trouble code (e.g. "$O_2$ sensor error"), and an identifier for the particular diagnostic tool that generated the record. The diagnostic tools may be associated with a particular employee or vehicle bay in a service center. In another embodiment, the diagnostic analysis system 104 performs the summarization or analyzes multiple service records from one or more diagnostic tools to produce a summary of the activities in one or more service centers. For example, in one embodiment the diagnostic analysis system 104 generates data for a KPI graph or other chart that depicts the total number of different vehicles that have been connected to diagnostic tools in a service center over the course of a work shift. The listener 124 receives the summarized report data from the diagnostic analysis system 104.

During process 300, the default listener 124 generates a default summarized user interface or "dashboard" that enables managers, service personnel, and other employees of the customer to review the service information (block 312). In one embodiment, the dashboard interface includes the service records that are formatted as human-readable text. The dashboard displays a list of the service records, and the default listener updates the list to display the most recently received service records from the diagnostic tools. The dashboard also displays graphs or summarized report information about the overall activity for one diagnostic tool, multiple diagnostic tools in a service center, or the aggregated activities of multiple service centers.

During process 300, the proprietary listener 128 also receives the service information from the diagnostic analysis system 104 (block 316). As described above, the proprietary listener 128 is a computing device that implements the public API to access diagnostic data and other service information that is associated with the customer in the diagnostic analysis system 104. The proprietary listener 128 then performs additional analysis or presents the service data in a different manner than the default listener 124. In one embodiment, the proprietary listener 128 is a customized software program that is executed on a computing device or the proprietary listener 128 is another server computing system that stores service information for the customer, and performs additional analysis on a wide range of customer service information. The proprietary listener 128 is under the control of a customer, such as the customer 114, and the customer 114 can configure and modify the proprietary listener to perform analysis that is of interest to the customer 114, but may not produce reports that are of a wide general interest to a large number of customers in the same manner as the default listener 124.

Figure 4:
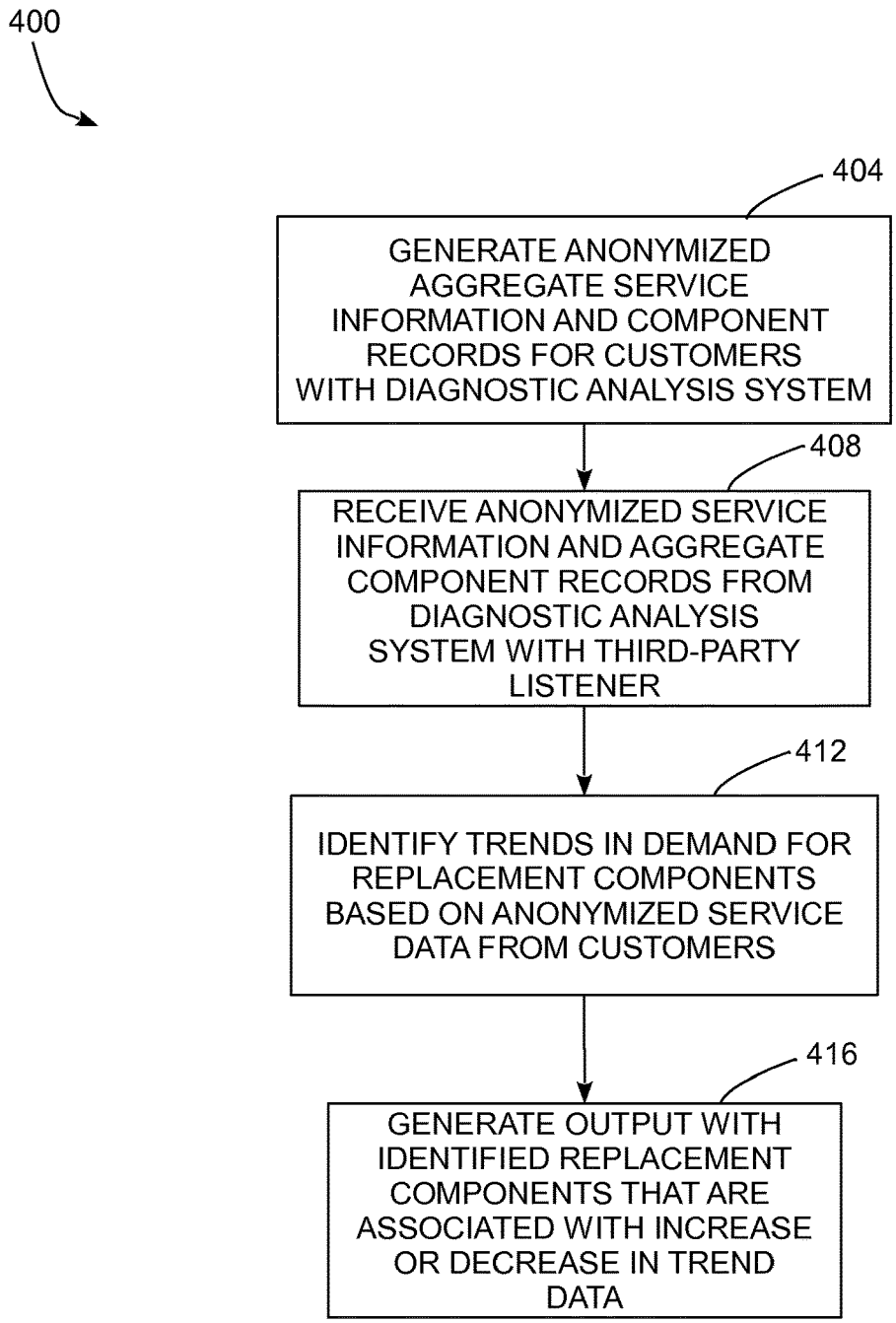
FIG. 4 is a block diagram of a process for analysis of anonymized data corresponding to the automotive service activities of multiple automotive service centers to provide information on the consumption of components and other components at the service centers.

FIG. 4 depicts a process 400 for a third-party listener to access the service information corresponding to one or more customers in a maintenance analysis system. During process 400, a third-party listener retrieves service information corresponding to either types of service procedures that the mechanic 160 and other mechanics perform using diagnostic and service procedure data from the diagnostic tools 116A-116C and 120A-120C. The third-party listeners also receive information about components that have been used during service and repair procedures. As described above, the diagnostic tools, such as the diagnostic tool 116C, receive and transmit the component data to the diagnostic history database 112 in the diagnostic analysis system 104. The process 400 enables third-party listeners 132 to receive aggregate records regarding the numbers and types of components that are used during service procedures in association with aggregate records about the makes, models, and years of vehicles that receive the parts, the service centers that perform the service operations, and other aggregate report records. FIG. 4 is described in conjunction with the system 100 of FIG. 1 for illustrative purposes.

In the embodiment of FIG. 4, the process 400 includes the generation of anonymized service information corresponding to anonymized service records, aggregate component records, and other analysis data for the customers to which the third-party listener has been granted access (block 404). For example, in one configuration the third-party listener 132 is granted access to the service information and aggregate component records for the customer 118, but not to the customer 114. The third-party listener 132 optionally receives metadata about the service information from the customers, such as store number identifiers or geographic coordinates that enable the third-party to identify the locations of service centers where the customers service vehicles and to associate service information with different service centers. However, the third-party listener does not have direct access to the diagnostic data and other service information in the same manner as the customer 118. Instead, the diagnostic analysis system 104 performs one or more anonymization operations to the service information before the third-party listener 132 receives the service information. For example, in some embodiments third-party listener 132 only receives aggregate information from the diagnostic analysis system 104. The diagnostic analysis system 104 identifies all service information that pertains to muffler component repair or replacement during a one-week time period for the customer. The third-party listener then receives only the aggregate statistics about muffler repair from the maintenance system 104, such as the total number and type of muffler components that were replaced during the one-week time period. The relationship between the third-party listener 132 and the customer can affect the policies for the type of information that is disclosed as well. For example, if the third-party listener 132 is registered to a company that sells muffler components for only Honda, Nissan, and Toyota vehicle makes, then the customer 118 can specify that the maintenance analysis service only returns service information for muffler activity for the aforementioned vehicle makes and not for other vehicle makes.

In another configuration for data anonymization, the third-party listener 132 is granted access to some individual service records, but the diagnostic analysis system 104 removes VIN data or any other unique data that enable the third-party to identify and track the service procedure history for an individual vehicle to preserve the privacy of drivers who use the customer for vehicle maintenance. If the third-party access requires the identification of a single vehicle to, for example, generate a vehicle history summary that tracks the effectiveness of service procedures for a single vehicle across multiple service visits, then the diagnostic analysis system 104 applies a pseudonymization process to the service information. The pseudonymization process generates a unique identifier for a vehicle across multiple diagnostic and service information records, but the unique identifier does not contain any meaningful information that identifies the vehicle in the same manner as a VIN.

Thus, the identifier is referred to as a pseudonymous identifier that has a similar function to a pseudonym for an author. For example, in one embodiment the diagnostic analysis system 104 generates a table or other suitable data structure in the customer database 108 that assigns a randomly generated number to each unique VIN that is collected from the diagnostic data that the diagnostic tools for the customer send to the diagnostic analysis system 104. The diagnostic analysis system 104 then uses the same random number in multiple records as a pseudonymous identifier for the vehicle in the service information that is sent to the third-party listener 132.

Process 400 continues as the third-party listener 132 receives the anonymized service information and aggregate component records (block 408). In one embodiment, the third-party listener 132 receives the service information data from the diagnostic analysis system 104 using the same pub-sub update system, although the third-party listeners use a different API to retrieve the service information than the public API for the diagnostic devices and customer listeners. In another embodiment, the third-party listener requests batches of the service information at regular intervals, such as on an hourly, daily, weekly, or monthly basis. The service information includes aggregated data pertaining to the types of service operations that are performed on multiple vehicles, aggregate information about the vehicles including make, model, and year data for the vehicles that the diagnostic analysis system 106 extracts from the VINs from the vehicles, and aggregate information about DTCs that the diagnostic analysis system 106 receives from the diagnostic tools 116A-116C and 120A-120C.

Similarly, the third-party listeners 132 receive aggregate information on the numbers of particular component types that have been installed in vehicles over different time intervals. In some embodiments, a third-party listener 132 that is associated with a component manufacturer has access to only the aggregate component information corresponding to the components that the manufacturer produces. For example, a third-party listener 132 for Manufacturer A receives aggregate component records for brake pad SKU A that Manufacturer A produces, while Manufacturer A does not receive aggregate component records for another brake pad SKU B from a different manufacturer.

Process 400 continues as the third-party listener 132 analyzes the anonymized service information to identify changes or trends in the services that the customers perform on vehicles to identify an increase or decrease in the demand for replacement components or other materials that the third-party supplies to the customers (block 412). For example, the third-party listener analyzes the service information to identify service tests and operations that require a vehicle battery replacement. In one situation, the trends show a uniform increase or decrease in demand for the batteries across all customers. In another situation, the trends indicate an increase in vehicle battery replacements for customer service centers in a certain geographic region, while the rate of replacements remains steady or decreases in another geographical region. In another situation, the trend data indicate an increase or decrease in the component demand for only one customer or only service center.

During process 400, the third-party listener 132 identifies the components that are the subject of increasing or decreasing trends in demand and generates an output with the identified components and the identified trends (block 416). For example, in one embodiment the third-party listener 132 generates a display of a map with an overlay of multiple service centers and graphical or numeric icons that indicate the changes in demand for a selected component. The graphical icons enable an efficient analysis of the trends in demand for the component across multiple customers. In another embodiment, the third-party listener 132 is further connected to an inventory management system for the third-party supplier. The third-party listener 132 generates an output that presents the identified trends in component demand, and presents a recommendation to adjust the overall level of inventory or the distribution of the inventory to match the changes in demand. For example, if a trend indicates that the eastern U.S. is experiencing an increase in demand for batteries while the western U.S. is experiencing a decrease in demand, then the third-party listener can recommend shipment of battery inventory to the eastern U.S. to meet increased demand for batteries from the customers.

Figure 5:
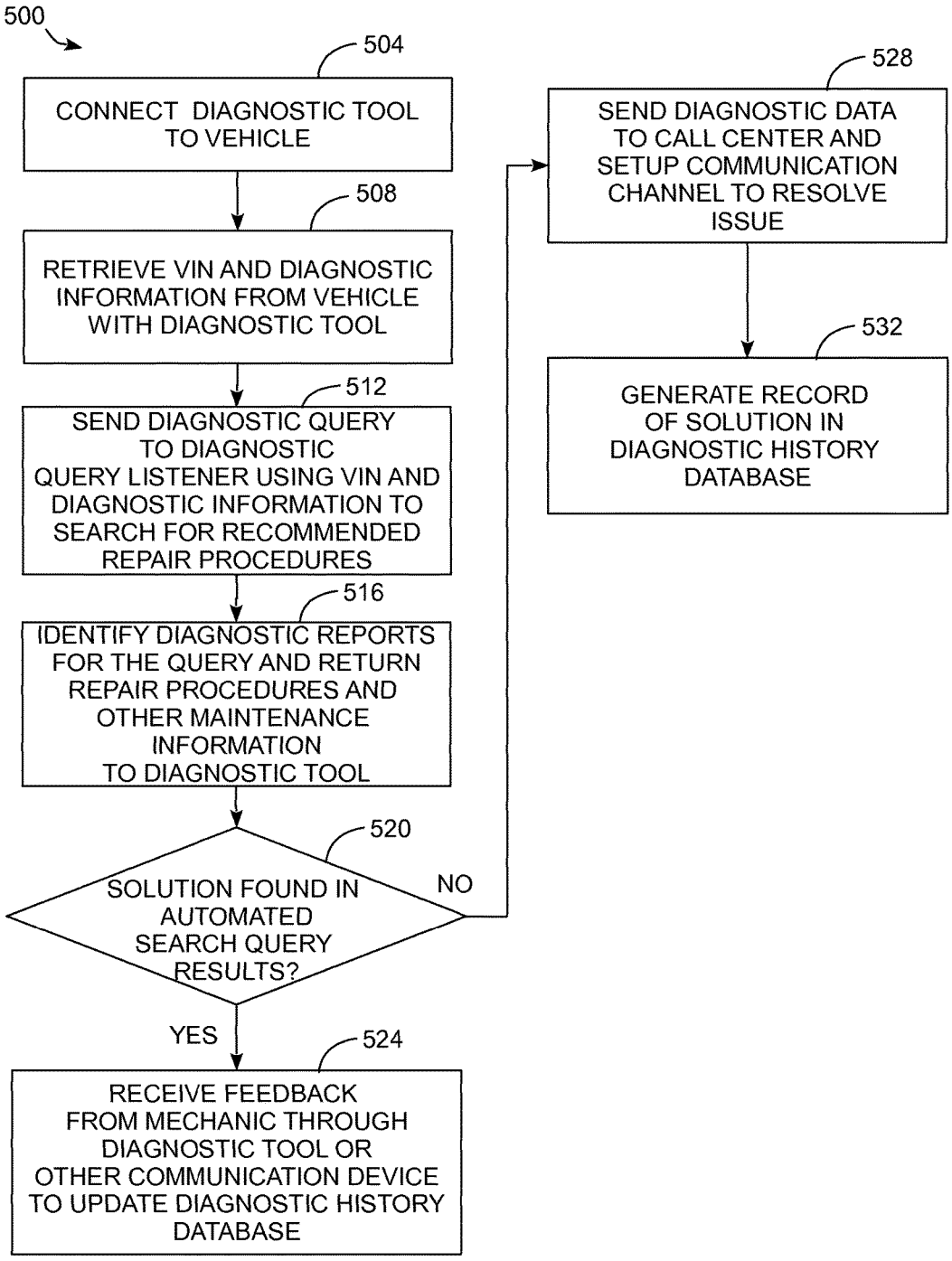
FIG. 5 is a block diagram of a process for identifying service procedures to assist a mechanic in resolving an issue with a vehicle using an automated system that receives diagnostic data from a diagnostic tool.

FIG. 5 depicts a process 500 for the operation of the system 100 to enable the mechanic 160 to retrieve recommendations for repairs and, if required, to contact the call center 140 to receive assist in resolving the issue. In the discussion below, a reference to the process 500 performing a function or action refers to the execution of stored program instructions by a processor to perform the function or action. Process 500 is described with reference to the system 100 of FIG. 1 for illustrative purposes.

Process 500 begins when the mechanic 160 or other automotive service technician connects a diagnostic tool to the ECU in a vehicle (block 504). As described above, the diagnostic tool 116C is configured to interface with a CAN bus or other in-vehicle data networking interface to retrieve diagnostic data from the ECU 166. Once connected to the ECU 166, the diagnostic tool 116C receives diagnostic data and optionally receives the VIN or other vehicle information data from the ECU 166 (block 508). The diagnostic data include, but are not necessarily limited to, DTC data, recorded sensor history data, and current data from sensors in the vehicle that are transmitted in an OBD-II compatible format. In one embodiment, the diagnostic tool 116C receives the VIN or other vehicle identification data from the ECU 166 in addition to receiving using, for example, the OBD-II mode 9 protocol. In another embodiment, the mechanic 160 enters the VIN or other identification information for the vehicle manually or through a barcode scanner to provide the VIN to the diagnostic tool 116C.

During process 500, the mechanic 160 enters a request using the diagnostic tool 116C for diagnosis and service recommendations based on the DTCs and other diagnostic data that have been received from the ECU (block 512). The diagnostic query includes both the diagnostic data and the VIN for the vehicle. The diagnostic tool 116C generates the diagnostic query with the diagnostic data and VIN in an automated manner. The mechanic 160 optionally enters additional terms for the diagnostic query using touchscreen interface or other input device associated with the diagnostic tool 116C. In one example, the diagnostic tool 116C generates a diagnostic query including two DTCs that are received from the ECU 166, the VIN for the vehicle, and a manually entered search term for "grinding noise" to complement the diagnostic data with observations from the mechanic 160 about the vehicle to assist in diagnosis of the issue.

The diagnostic analysis system 104 receives the diagnostic query from the diagnostic tool 116C and generates query results from the diagnostic information in the diagnostic history database 108 (block 516). In one embodiment, the diagnostic analysis system 104 queries the diagnostic history database 108 first to identify if the combination of DTCs and other diagnostic data that are presented in the diagnostic query correspond to one or more service records in the database 108 that correspond to previously recorded solutions to a vehicle issue that correspond to the same diagnostic data. The diagnostic analysis system 104 also refines the search using the VIN or other vehicle identification data in the diagnostic query. The diagnostic analysis system 104 uses the VIN to associate the make, model, and year of the vehicle with existing service records to identify the records for similar vehicles with the greatest likelihood of relevance to the mechanic 160. If the DTC data corresponds to one or more service records, but the diagnostic history database 108 does not associate the DTC data with the particular VIN of the vehicle, then the diagnostic analysis system 104 returns results for the service records that correspond to the DTCs, with an indicator that identifies the different make, model, or year of the vehicles that pertain to the service records.

In one embodiment, the diagnostic analysis system 104 implements a web server, and the results from the diagnostic query are presented as one or more web pages for display through the diagnostic tool 116C or any other computing device that includes a web browser. If the diagnostic query results in multiple potentially relevant results, the diagnostic analysis system 104 generates results including brief summary information and hyperlinks or other control elements to enable the mechanic 160 to review multiple results using a web browser or other suitable viewing software with the diagnostic tool 116C.

During process 500, the mechanic reviews the results from the search and determines if one of the service records describes a solution to the vehicle repair issue. In the system 100, the diagnostic tool 116C implements a web browser or other software that enables the mechanic 160 to review the service records. In another embodiment, the mechanic 160 uses the mobile device 168 or another computing device, such as a PC, to review the results.

In many instances, the results from the diagnostic analysis system 104 include an appropriate solution for the mechanic to fix the issue with the vehicle (block 520). The mechanic 160 then enters feedback using the diagnostic tool 116C or mobile device 168 to update the diagnostic history database 108 (block 524). Since many automotive repairs can take hours or even days to complete, the diagnostic analysis system 104 is configured to receive the feedback after the mechanic 160 has had an opportunity to perform a recommended procedure and verify the efficacy of the procedure. For example, in one embodiment the diagnostic tool 116C presents a feedback menu to the mechanic 160 after a timeout period. The timeout is a predetermined time period (e.g. 24 hours) or a timeout that is based on an expected amount of time to perform the repair based on a time estimate that is included with the service records. For example, the diagnostic tool 116C presents the feedback interface for a service record with a recommendation for a job with an estimated 8 hour completion time after the estimated time has elapsed.

The diagnostic system 104 uses the simplified feedback to adjust a relevance ranking of the service record that corresponds to the feedback. For example, as one or more mechanics review a service record with a proposed procedure for a particular set of DTCs, positive feedback indicates that the service record was useful in fixing the problem with the vehicle. The positive feedback increases the likelihood that the diagnostic analysis system 104 returns the service record in response to additional queries that specify the DTCs or other diagnostic and vehicle identification data corresponding to the service record. When returning multiple service records in response to a diagnostic query, the diagnostic analysis system 104 ranks the service records based on the feedback. The diagnostic analysis system 104 returns results to queries from mechanics in order based on the ranking to present the service records with high rankings to the mechanic first. Negative feedback decreases the ranking of a service record. In one configuration, if a service record receives a predetermined number of negative feedback results, while having no or few positive feedback results, then the diagnostic analysis system 104 omits the service record from diagnostic query results.

In the system 100, the feedback interface includes both simplified and detailed input controls for the mechanic 160. For example, a simplified feedback interface includes a summary of the vehicle and DTC information and the recommended diagnosis to remind the mechanic 160 of a service record that was previously retrieved for a vehicle. The simplified feedback interface also presents a yes/no or a multiple choice question for the mechanic 160 to elicit feedback as to whether the service record was useful in solving the problem. The simplified feedback interface receives the feedback input in a standardized manner that requires minimal time for the mechanic 160. The feedback interface also presents a detailed input interface. The detailed input interface is, for example, a form that includes more detailed questions about the repair process (e.g. time needed for the repair, components used in the repair, tools used for the repair, etc.) and a text input to enable the mechanic 160 to enter an explanation of the problem and the repair process. The detailed feedback is useful when the mechanic 160 receives service records that assist the mechanic 160 in diagnosing and fixing the problem, and where the mechanic 160 wants to add additional details to existing service records that are stored in the diagnostic history database 108.

In some instances, the mechanic 160 is unable to resolve the repair issue with the vehicle using the service records that that diagnostic analysis system 104 returns in response to the diagnostic query from the diagnostic tool 116C (block 520). In a situation where the diagnostic analysis system 104 does not identify a relevant service record or where the mechanic 160 does not receive a service record that resolves the issue, the mechanic 160 uses the diagnostic tool 116C or mobile device 168 to request manual assistance for information corresponding to the diagnostic query. In the diagnostic analysis system 104, the diagnostic query listener 156 transmits the diagnostic query information to an operator in the call center 140, and transmits address data to the diagnostic tool 116C or mobile device 168 that are associated with the mechanic 160 to establish a communication channel between the mechanic 160 and a technician in the call center 140 (block 528). As described above, the diagnostic query listeners 156 establish a communication channel between the mechanic 160 and the call center 140. In one embodiment, the diagnostic query listeners 156 transmit communication address data to the mobile device 168 or diagnostic tool 116C. Address data include, for example, a phone number or a uniform resource locator (URL) that enables the mechanic to establish a communication channel with a human operator in the call center 140. The mobile device 168 and diagnostic tool 116C use the address data to establish the communication channel through the network 150. Examples of communication channels include telephone calls, or text, audio, and video chat sessions. In the example of FIG. 1, the mechanic 160 uses the diagnostic tool 116C or mobile device 168 to communicate with a human operator in the call center 140. The human operator in the call center 140 receives the diagnostic data from the diagnostic tool 116C automatically to assist the human operator in understanding and in providing assistance to the mechanic 160.

During process 500, the diagnostic analysis system 104 receives input from the mechanic 160 or from an operator in the call center 140 to generate a new service record of the solution to the issue that is stored in the diagnostic history database 108 (block 532). The diagnostic analysis system 104 automatically includes the VIN and DTC and other diagnostic data from the diagnostic tool 116C in the service record. The VIN and DTC data enable the diagnostic analysis system 104 to retrieve the service record in the future when another mechanic receives similar DTC data and requires additional information to diagnose an issue with the vehicle. The service record also includes text or other data that the mechanic 160 enters manually to describe the issue and the methods for resolving the issue. In addition to a text description, the data in the service record can include component numbers for any required replacement components, and pictures or videos that assist in explaining the issue and the procedure to resolve the issue. After performing the repair, the mechanic 160 also provides an estimate of the amount of time required to perform the repair, which assists other mechanics in estimating the cost of repair for the issue.

The diagnostic analysis system 104 stores the service record in the diagnostic history database 108 in association with the user accounts for the mechanic 160 and optionally an account of an operator in the call center 140 who assists in resolving the issue. The service record provides a potential solution to the issue for other mechanics who operate diagnostic tools or mobile devices that retrieve the service record from the diagnostic analysis system 104.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the following claims.

What is claimed:

1. A method for monitoring vehicle service activity comprising:

receiving with a plurality of diagnostic tools a plurality of diagnostic data from a plurality of vehicles;

transmitting with the plurality of diagnostic tools the plurality of diagnostic data and a plurality of service records corresponding to a plurality of service procedures performed on the plurality of vehicles in response to the plurality of diagnostic data from the plurality of vehicles to a diagnostic history database in a server;

receiving with one diagnostic tool in the plurality of diagnostic tools first diagnostic data from the one vehicle in the plurality of vehicles;

transmitting with the one diagnostic tool the first diagnostic data and a diagnostic query to the server;

identifying with the server a service record stored in the diagnostic history database corresponding to the diagnostic data and the diagnostic query;

transmitting with the server the service record to the one diagnostic tool as a solution in response to the diagnostic data and the diagnostic query;

transmitting with the server the first diagnostic data and the diagnostic query to a diagnostic query listener computing device in response to the solution from the server being unable to resolve a repair issue with the vehicle; and establishing with the diagnostic query listener computing device a communication channel between the one diagnostic tool and a terminal in a call center to enable communication between a user of the one diagnostic tool and an operator in the call center to diagnose an issue with the one vehicle related to the first diagnostic data in response to the solution from the server being unable to resolve the repair issue with the vehicle, the establishing further comprising:

transmitting with the query listener computing device the first diagnostic data to the terminal in the call center; and presenting with the terminal in the call center the first diagnostic data from the one diagnostic tool.

2. The method of claim 1 further comprising:

generating with the server a summary of the plurality of service procedures with reference to the plurality of service records and the plurality of diagnostic data from the plurality of diagnostic tools;

transmitting with the server the summary to a listener computing device associated with a service center that performs at least one service procedure on one vehicle in the plurality of vehicles;

receiving with the one diagnostic tool in the plurality of diagnostic tools first diagnostic data from one vehicle in the plurality of vehicles;

transmitting with the one diagnostic tool the first diagnostic data and a first service record corresponding to a first service procedure performed on the one vehicle in response to the first diagnostic data from the one vehicle to the server;

receiving with the one diagnostic tool second diagnostic data from the one vehicle;

transmitting with the one diagnostic tool the second diagnostic data and a second service record corresponding to a second service procedure performed on the one vehicle in response to the second diagnostic data from the one vehicle to the server;

updating with the server the summary of the plurality of service procedures corresponding to a vehicle history with reference to the first service record, the second service record, the first diagnostic data, and the second diagnostic data; and transmitting with the server the updated summary to the listener computing device.

3. The method of claim 2 further comprising:

receiving with the one diagnostic tool a vehicle identification number (VIN) from the one vehicle;

transmitting with the one diagnostic tool the VIN with the first diagnostic data and a first service record to the server;

transmitting with the one diagnostic tool the VIN with the second diagnostic data and a second service record to the server; and updating with the server the summary of the plurality of service procedures corresponding to the vehicle history with reference to the VIN to associate the first service record, the second service record, the first diagnostic data, and the second diagnostic data with the one vehicle.

4. The method of claim 3 further comprising:

identifying with the server at least one of a make, model, and year of the vehicle with reference to the VIN; and generating with the server the vehicle history summary including the at least one make, model, and year of the vehicle.

5. The method of claim 1 further comprising:

receiving with the plurality of diagnostic tools a plurality of vehicle identification numbers (VINs) each VIN in the plurality of VINs corresponding to one vehicle in the plurality of vehicles;

transmitting with the plurality of diagnostic tools the plurality of VINs to the server;

identifying with the server at least one of a make, model, and year of each vehicle in the plurality of vehicles with reference to the plurality of VINs; and generating with the server the summary of the plurality of service procedures including the at least one make, model, and year of each vehicle in the plurality of vehicles.

6. The method of claim 1 further comprising:

receiving with the one diagnostic tool a vehicle identification number (VIN) from an electronic control unit in the one vehicle;

transmitting with the one diagnostic tool the VIN to the server;

identifying with the server at least one of a make, model, and year of the vehicle with reference to the VIN; and identifying with the server the service record stored in the diagnostic history database corresponding to a service procedure performed on another vehicle having at least one of the make, model, and year of the one vehicle.

* * * * *